US012523115B2

(12) United States Patent
McChesney et al.

(10) Patent No.: US 12,523,115 B2
(45) Date of Patent: Jan. 13, 2026

(54) USING AN INTERNAL HYDRAULIC CONTROL SYSTEM TO FUNCTION AN ELECTRIC INFLOW VALVE

(71) Applicant: Halliburton Energy Services, Inc., Houston, TX (US)

(72) Inventors: Ryan W. McChesney, Carrollton, TX (US); Gordon McLeary, Carrollton, TX (US); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/536,509

(22) Filed: Dec. 12, 2023

(65) Prior Publication Data

US 2025/0188814 A1 Jun. 12, 2025

(51) Int. Cl.

| | |
|---|---|
| ***E21B 34/10*** | (2006.01) |
| ***E21B 34/06*** | (2006.01) |
| ***E21B 43/12*** | (2006.01) |

(52) U.S. Cl.

CPC ..... *E21B 34/066* (2013.01)

(58) Field of Classification Search

CPC ..... E21B 43/12; E21B 34/10; E21B 43/14; E21B 34/066

See application file for complete search history.

(56) References Cited

U.S. PATENT DOCUMENTS

| | | | |
|---|---|---|---|
| 10,280,708 | B2 * | 5/2019 | Lamb ..... E21B 34/066 |
| 10,428,619 | B2 | 10/2019 | Poluchalla et al. |
| 10,544,652 | B2 | 1/2020 | Fripp et al. |
| 10,704,360 | B2 | 7/2020 | Poluchalla et al. |
| 10,724,334 | B2 | 7/2020 | Poluchalla et al. |
| 11,008,831 | B2 | 5/2021 | Minassa et al. |
| 11,105,183 | B2 | 8/2021 | Frosell et al. |
| 11,187,060 | B2 | 11/2021 | Minassa et al. |

(Continued)

FOREIGN PATENT DOCUMENTS

| | | |
|---|---|---|
| CN | 101349148 A | 1/2009 |
| WO | 2016073675 A1 | 5/2016 |

OTHER PUBLICATIONS

International Search Report and Written Opinion for International Patent Application No. PCT/US2023/086493 dated Sep. 3, 2024. PDF file. 8 pages.

*Primary Examiner* — Kipp C Wallace
(74) *Attorney, Agent, or Firm* — Scott Richardson; C. Tumey Law Group PLLC

(57) ABSTRACT

An inflow control device for a well that may include a chamber, a cavity fluidly connected to the chamber, wherein the cavity comprises a seat, a fluid passageway fluidly connected to the cavity, and an actuator at least partially disposed within the chamber and at least partially disposed in the cavity. The inflow control device may further include a hydraulic passageway fluidly connected to the chamber, a fluid pressure storage fluidly connected to both the hydraulic passageway, and a solenoid disposed on the hydraulic passageway and configured to control a flow of a hydraulic fluid from the fluid pressure storage to the chamber. The method may include receiving a fluid from a formation with an inflow control device (ICD) disposed on a tubular string within a formation and adjusting the actuator within the chamber and the cavity using the solenoid.

16 Claims, 5 Drawing Sheets

(56) References Cited

U.S. PATENT DOCUMENTS

| | | | | |
|---|---|---|---|---|
| 11,274,526 | B2 | 3/2022 | Deville et al. | |
| 11,280,168 | B2 | 3/2022 | Greci et al. | |
| 11,287,357 | B2 | 3/2022 | Greci et al. | |
| 11,352,862 | B2 | 6/2022 | Zachariah et al. | |
| 11,365,610 | B2 | 6/2022 | McChesney et al. | |
| 11,448,047 | B2 | 9/2022 | McChesney et al. | |
| 11,530,596 | B2 | 12/2022 | McChesney et al. | |
| 11,719,076 | B2 | 8/2023 | McChesney et al. | |
| 2010/0038093 | A1* | 2/2010 | Patel | E21B 43/12 166/373 |
| 2011/0067886 | A1* | 3/2011 | Moen | E21B 43/12 166/321 |
| 2011/0198097 | A1* | 8/2011 | Moen | E21B 43/14 166/324 |
| 2017/0275968 | A1* | 9/2017 | Purkis | E21B 34/103 |
| 2018/0274331 | A1* | 9/2018 | Richards | E21B 43/045 |
| 2018/0283133 | A1* | 10/2018 | Poluchalla | E21B 34/066 |
| 2019/0055814 | A1* | 2/2019 | Frosell | E21B 34/16 |
| 2019/0316440 | A1* | 10/2019 | Honeker | E21B 47/07 |
| 2020/0208496 | A1 | 7/2020 | Veselka et al. | |
| 2022/0195837 | A1 | 6/2022 | McChesney et al. | |

* cited by examiner

USING AN INTERNAL HYDRAULIC CONTROL SYSTEM TO FUNCTION AN ELECTRIC INFLOW VALVE

BACKGROUND

Production tubing and other equipment can be installed in a wellbore of a well system (e.g., an oil or gas well) for communicating fluid in the wellbore to the well surface. The resulting fluid at the well surface is referred to as production fluid. Production fluid can include a mix of different fluid components, such as oil, water, and gas, and the ratio of the fluid components in the production fluid can change over time. This can make it challenging for a well operator to control which types of fluid components are produced from the wellbore. For example, it can be challenging for a well operator to produce mostly oil from the wellbore, while reducing or eliminating the production of gas or water from the wellbore.

BRIEF DESCRIPTION OF THE DRAWINGS

These drawings illustrate certain aspects of some of the embodiments of the present disclosure and should not be used to limit or define the method.

DETAILED DESCRIPTION

A downhole flow control device is disclosed for controlling the production of formation fluids during operations. Generally, inflow control devices (ICDs) may be utilized to control the flow of fluid from the formation to the inner diameter of a tubing string. Currently, ICDs may rely on a magnetic coupler to allow an actuator contained in an atmospheric chamber to move a magnetic array in the reservoir fluid to open and close the production valve. The magnetic arrays have limited coupling force due to size constraints and require a thin wall between the arrays, limiting the downhole pressure rating. The methods and systems described below may utilize a hydraulic system to open and close the valve rather than using magnetic coupling forces. The hydraulic system would use a series of solenoid valves to control an actuator in each ICD. Further, the systems and method may be pressurized with a high-pressure fluid reservoir stored on board the tool.

Figure 1:
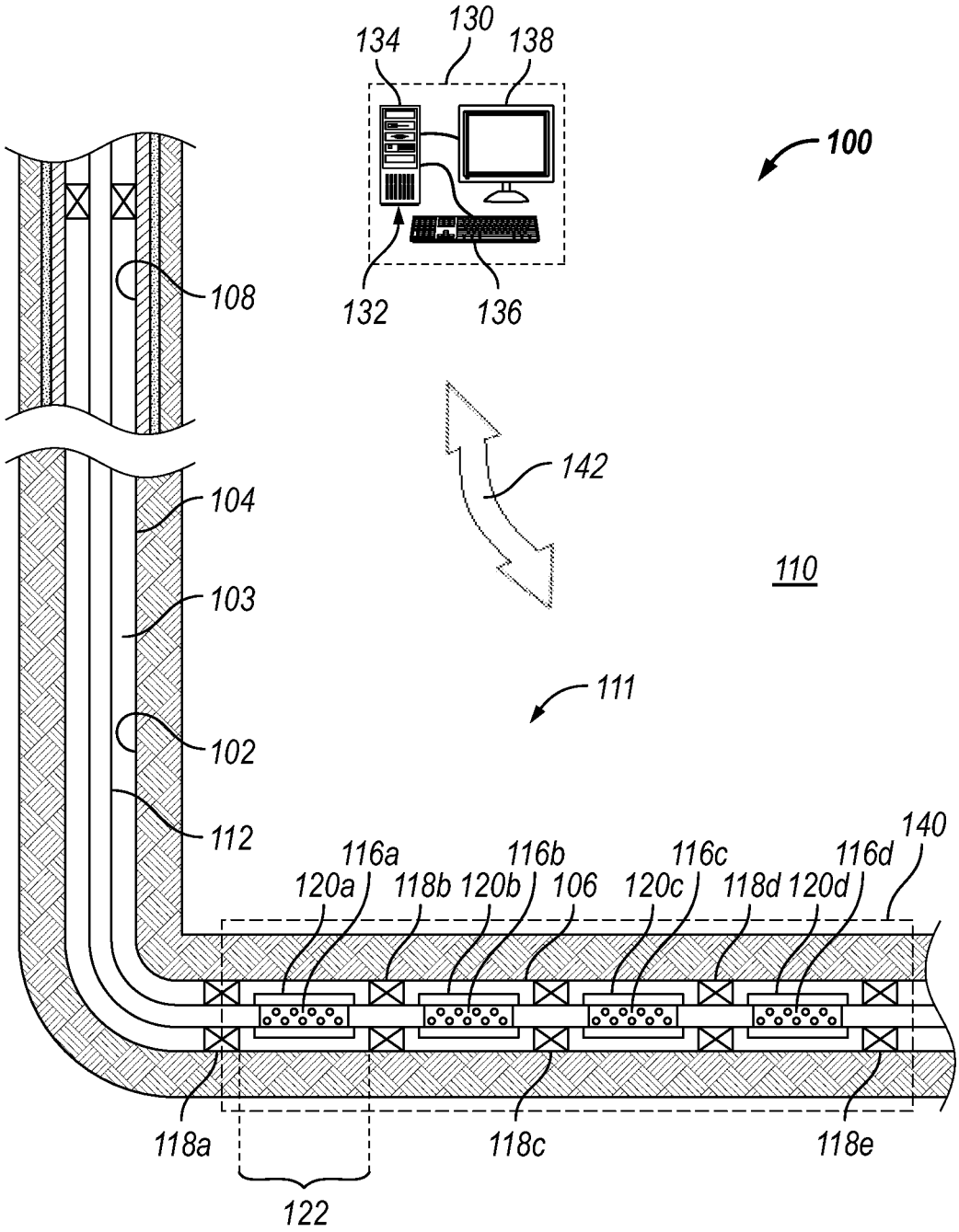
FIG. 1 is an elevation view of an example of a well system in which a flow control system may be implemented according to aspects of this disclosure.

FIG. 1 is an elevation view of an example of a well system 100 in which a flow control system 140 may be implemented according to aspects of this disclosure. This figure is simplified in some respects for discussion and is not too scale. Well system 100 includes a wellbore 102 extending through various earth strata of a subterranean formation 110. Wellbore 102 may follow any suitable wellbore trajectory to reach a desired production zone 111 of formation 110. The trajectory may include an initial vertical wellbore section and one or more deviated sections employing directional drilling techniques. In this simplified example, wellbore 102 has an initial, substantially vertical section 104 that transitions to a substantially horizontal section 106 traversing production zone 111. Portions of the wellbore may be cased for reinforcement, while other portions may be substantially non-reinforced, i.e., open hole. Here, the substantially vertical section 104 may include a string of casing 108 cemented at an upper portion of the substantially vertical section 104, while horizontal section 106 traversing production zone 111 is open hole.

A tubular string 112 extends from an above ground location (i.e., a surface of the well site) along the wellbore 102, defining an annulus 103 between tubular string 112 and wellbore 102 along the open hole portions and with the casing 108 along the cased portions. Tubular string 112 may be included with an upper completion that may provide a conduit for fluid (e.g., production fluid) to travel from the substantially horizontal section 106 to the well's surface. The tubular string 112 can include any number of production tubular sections 116, examples of which are individually indicated at 116*a*-116*d*, at various production intervals adjacent to the subterranean formation 110. A corresponding number of packers 118, individually indicated at 118*a*-118*c*, can be positioned on opposing sides of production tubular sections to define production intervals (e.g., production interval 122) and provide fluid seals between the tubular string 112 and the wall of the wellbore 102.

Any number of inflow control devices (ICDs) 120, individually indicated at 120*a*-120*d*, may be included for production of formation fluids into the tubular sections 116. The inflow control devices 120 are examples of downhole flow control devices that can be included with the flow control system 140 and which can utilize a turbine as further disclosed below. Generally, inflow control devices are used to control the flow of formation fluid from a production interval into a production tubular section. Generally, an ICD may create a pressure drop, which may be used, for example, to help balance the influx of production fluids from a length of a horizontal section to reduce heel-toe effects, or to slow the flow from a highly permeable zone in an effort delay water or gas breakthrough. Although not required, some ICDs may be autonomous ICDs (i.e., AICDs) that are additionally capable of autonomously restricting undesired fluid or fluid components to a greater extent. ICDs 120 may be used individually to restrict the flow of certain fluid components, thereby collectively increasing a proportion of desired fluid components. For example, the production interval 122 may produce formation fluid having more than one type of fluid component, such as oil, water, carbon dioxide, and natural gas. Each inflow control device 120 uses the properties of different fluid components such as density and/or viscosity to reduce or restrict the flow of fluid of less desirable fluid components (e.g., water and CO2) into the production tubular section 116 while collectively producing a higher proportion of a more desirable fluid components, such as oil. In some examples, the inflow control devices 120 can be autonomous inflow control devices (AICDs) that can allow or restrict fluid flow into the production tubular sections 116 based on fluid properties such as density, viscosity, etc., without requiring signals from the well's surface by the well operator.

For case of illustration, FIG. 1 depicts each production tubular section 116 as having an inflow control device (ICD) 120. However, a given zone or production tubular section may have more than one ICD 120, and not every zone or production tubular section may have an inflow control device 120. Also, production tubular sections 116 (and the inflow control devices 120) may be located in substantially vertical section 104 additionally or alternatively to substantially horizontal section 106. Further, any number of production tubular sections 116 with inflow control devices 120 may be used in well system 100. In some examples, production tubular sections 116 with inflow control devices 120 may be disposed in simpler wellbores, such as wellbores 102 having only a substantially vertical section 104. Inflow control devices 120 may be disposed in cased wells or in open-hole environments.

With continued reference to FIG. 1, ICDs 120 may communicate with and/or be controlled by an information handling system 130, which may be disposed at surface and/or at least partially disposed at surface and partially disposed on and/or near an ICD 120 on tubular section 116 downhole. An information handling system 130 may include any instrumentality or aggregate of instrumentalities operable to compute, estimate, classify, process, transmit, broadcast, receive, retrieve, originate, switch, store, display, manifest, detect, record, reproduce, handle, or utilize any form of information, intelligence, or data for business, scientific, control, or other purposes. For example, an information handling system 130 may be a personal computer, a network storage device, or any other suitable device and may vary in size, shape, performance, functionality, and price.

Information handling system 130 may include a processing unit 132 (e.g., microprocessor, central processing unit, etc.) that may process data by executing software or instructions obtained from a local non-transitory computer readable media 134 (e.g., optical disks, magnetic disks). The non-transitory computer readable media 134 may store software or instructions of the methods described herein. Non-transitory computer readable media 134 may include any instrumentality or aggregation of instrumentalities that may retain data and/or instructions for a period of time. Non-transitory computer readable media 134 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Information handling system 130 may also include input device(s) 136 (e.g., keyboard, mouse, touchpad, etc.) and output device(s) 138 (e.g., monitor, printer, etc.). The input device(s) 136 and output device(s) 138 provide a user interface that enables an operator to interact with ICDs 120 and/or software executed by processing unit 132. Generally, information handling system 130 may communicate to ICDs 120 by communication channel 142. Communication channel 142 may be performed by mud pulse telemetry. For example, Surface equipment, controlled by information handling system 130, may be connected to a production valve or choke. Information handling system 130 may tell/control the production valve/choke to open or partially close in a specific pattern which in turn alters the flow rate of fluids with wellbore 102. An EICD's turbine generator senses this flow rate changes as a change in RPM of the turbine. The EICD decodes this sequence of RPM changes to determine if it should open, close, choke, etc. This sequence may be specific to a certain EICD in tubular string 112 or maybe commanding a group of pre-programmed EICDs to respond to the same command.

Additionally, an ICD may also operate autonomously if pre-programmed. The ICD may respond to changes in wellbore 102 based upon things like turbine RPM. ICD may also have sensors onboard such as a water cut sensor that could sense water or gas and could trigger ICD to close or choke. Using the systems and methods described above, information handling system 130 may enable an operator to increase or decrease flow of fluid through ICDs 120, as discussed below.

Figure 2:
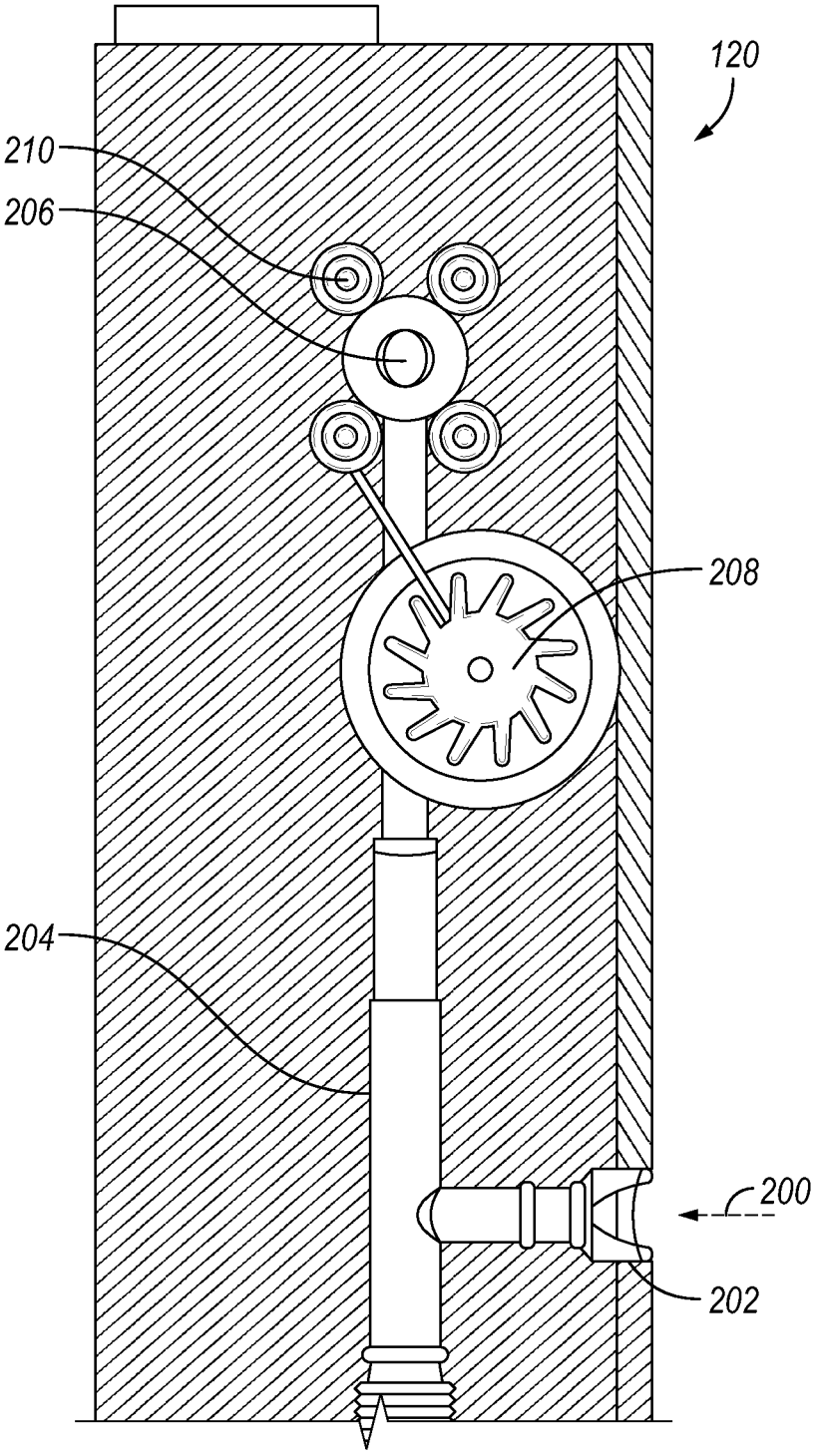
FIG. 2 is an example of a power generator disposed in an inflow control device (ICD).

FIG. 2 illustrates an ICD 120 in accordance with one or more embodiments of the present disclosure. As illustrated, a fluid 200 (which may comprise one or more fluids, such as oil and water, liquid water and steam, oil and gas, gas and water, oil, water and gas, etc.) may be filtered by a well screen (at tubular section 116) and may then flow into an inlet flow path 202 of ICD 120. Fluid 200 may comprise one or more undesired or desired fluids. Both steam and water may be combined in fluid 200. As another example, oil, water and/or gas may be combined in fluid 200. The flow of fluid 200 through ICD 120 may be resisted due to diameter of fluid passageway 204. In examples, fluid passageway 204 may be tubing, voids within a housing, three dimensional printed paths within a material, gun drilled flow paths, and/or the like. Additionally, it should be noted that fluid passageway 204 may be any suitable shape and/or dimension to allow for fluid to flow from outside ICD to the inside tubular string 112 in which and ICD 120 may be disposed (e.g., referring to FIG. 1). This may control the flow rate of fluid 200 flowing through ICD 120. Fluid 200 may then be discharged from ICD 120 to an interior of tubular string 112 via an outlet flow path 206. As used herein, the direction of the flow of fluid 200 from inlet flow path 202 to outlet flow path 206 be reversed, such as during injection applications, through ICD 120 such that the flow of fluid 200 may originate at outlet flow path 206 and traverse to inlet flow path 202, where fluid 200 may be dispelled into formation 110 and/or wellbore 102.

In other examples, well screens may not be used in conjunction with ICD 120 (e.g., in injection operations) and fluid 200 may flow in an opposite direction through the various elements of well system 100 (e.g., in injection operations). In other examples, a single ICD 120 may be used in conjunction with multiple well screens or multiple ICDs 120 may be used with one or more well screens. Thus, fluid 200 may be received from or discharged into regions of wellbore 102 other than annulus or tubular string 112. Additionally, flow of fluid 200 may flow through ICD 120 prior to flowing through the well screen and any other components may be interconnected upstream or downstream of the well screen and/or any ICD 120. Thus, the principles of this disclosure are not limited at all to the details of the example depicted in the figures and described herein. Further, additional components (such as shrouds, shunt tubes, lines, instrumentation, sensors, inflow control devices, etc.) may also be used in accordance with the present disclosure, if desired.

With continued reference to FIG. 2, ICD 120 may include various passages and devices for performing various functions, as described more fully below. In addition, ICD 120 may at least partially extend circumferentially about tubular string 112, or ICD 120 may be formed in a wall of a tubular structure interconnected as part of tubular string 112. In other examples, ICD 120 may not extend circumferentially about tubular string 112 or be formed in a wall of a tubular structure. For example, ICD 120 may be formed in a flat structure, etc. ICD 120 may be in a separate housing that is attached to tubular string 112, or it may be oriented so that the axis of outlet flow path 206 is parallel to the axis of tubular string 112. ICD 120 may be on a logging string, production string, drilling string, coiled tubing, or other tubular string or attached to a device that is not tubular in shape. Any orientation or configuration of ICD 120 may be used in keeping with the principles of this disclosure.

As illustrated in FIG. 2, ICD 120 comprises inlet flow path 202 to receive fluid 200 into ICD 120 and outlet flow path 206 to send fluid 200 out of ICD 120 into the interior of tubular string 112, as discussed above. When fluid exits ICD 120, fluid 200 may, for example, enter into the interior of a tool body or out of the exterior of a tool body used in conjunction with ICD 120. Additionally, ICD 120 may comprise one or more power sources. For example, ICD 120 may include a power generator 208 and/or one or more power storage devices 210. Power generator 208 may be used to generate power for ICD 120, and power storage devices 210 may be used to provide stored power for ICD 120 and/or store power generated by power generator 208. In one embodiment, power generator 208 may include a turbine and may be able to generate power from fluid 200 received into inlet flow path 202 and flowing through ICD 120. Power generator 208 may additionally or alternatively include other types of power generators, such as a flow induced vibration power generator and/or a piezoelectric generator, to generate power from the fluid received into ICD 120 and/or from other energy sources present downhole (e.g., temperature and/or pressure sources).

Power storage devices 210 may be included within electronics for ICD 120 and may be used to provide stored power. In one embodiment, power storage devices 210 may be able to store power generated by power generator 208 and provide this stored powered for ICD 120. Power storage device 210 may comprise a capacitor (e.g., super capacitor), battery (e.g., rechargeable battery), and/or any other type of power storage device known in the art. In one or more embodiments, devices, components, and/or the like of ICD 120 may require power generated by power generator 208. Additionally, power storage device 210 may be used to store power, and then supplement power generator 208 when running devices, components, and/or the like that may be housed and/or connected to ICD 120.

Figure 3:
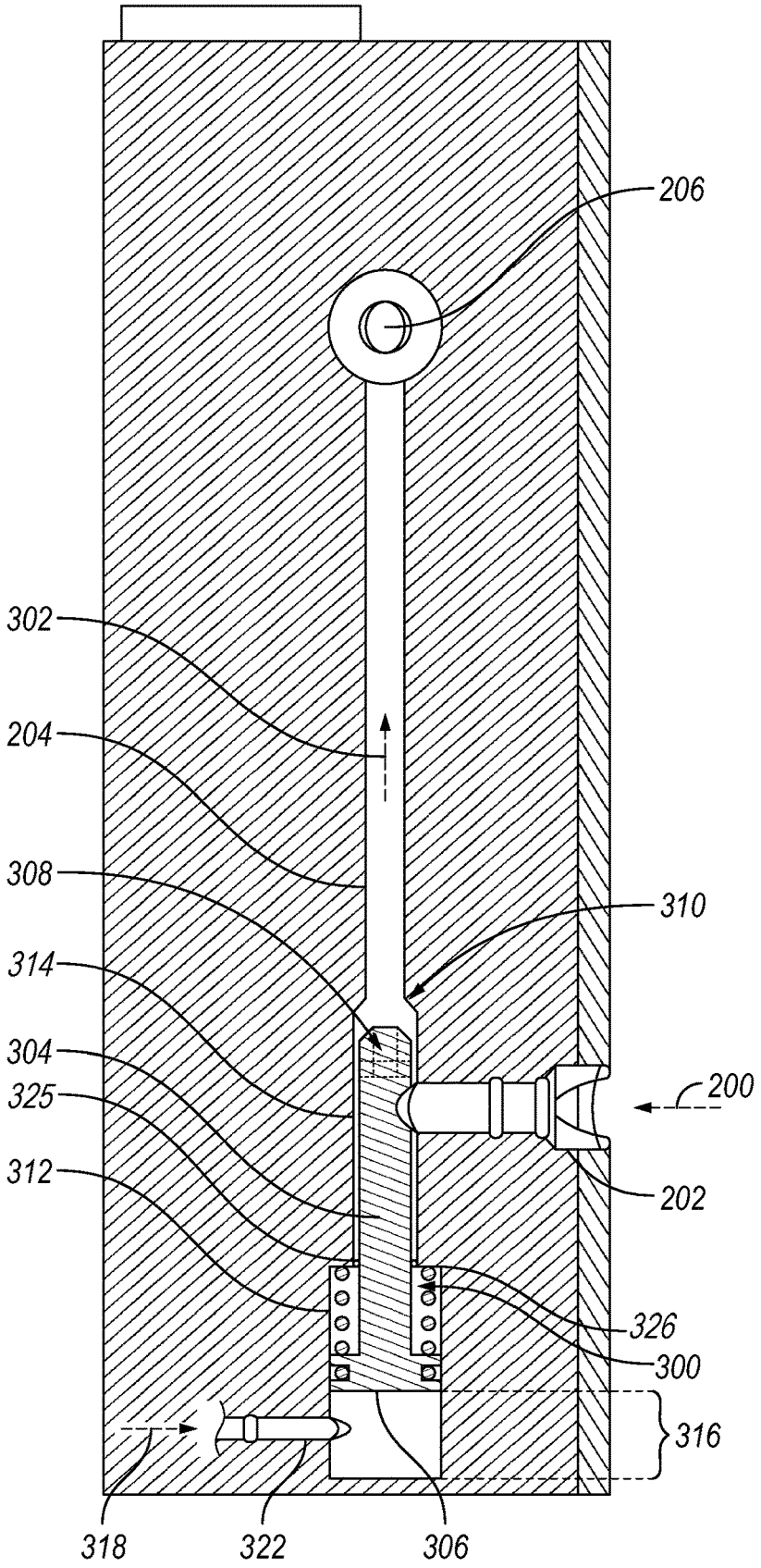
FIG. 3 is an example of an actuator disposed in an ICD.

FIG. 3 illustrates an ICD 120 with an actuator 300. In this example, ICD 120 may comprise an actuator 300 which may control the flow of fluid 200 into tubular string 112. As illustrated, fluid 200 may enter into ICD 120 through inlet flow path 202. During operations, fluid 200 may flow into tubular string 112 due to a pressure imbalance between the outside of tubular string 112 and inside of tubular string 112, as discussed above. In one or more examples, the flow of fluid 200 may be stopped utilizing actuator 300.

Actuator 300 may control or adjust an inflow rate of fluid 200 received into ICD 120 through inlet flow path 202. Additionally, actuator 300 may control or adjust the restriction of fluid 200 received into ICD 120 by controlling and/or adjusting a drop in pressure between inlet flow path 202 and outlet flow path 206. For example, actuator 300 may be positioned or included within ICD 120 to extend into and retract from fluid flow path 302 in fluid passageway 204, which may extend and be formed through ICD 120. To increase the inflow rate of fluid 200 or decrease the inflow fluid restriction or pressure drop across ICD 120, actuator 300 may retract to enable more fluid to flow through fluid flow path 302 of ICD 120. To decrease the inflow rate of fluid 200 or increase the inflow fluid restriction or pressure drop across ICD 120, actuator 300 may extend to restrict the fluid flow through fluid flow path 302 of ICD 120. Further, in one or more embodiments, the actuator 300 may be used to fully stop or inhibit the fluid flow through fluid flow path 302 of ICD 120. For example, if ICD 120 is turned or powered off, actuator 300 may fully extend to prevent fluid flow through fluid flow path 302 of ICD 120. Accordingly, actuator 300 may be used as or include an adjustable valve to be in a fully open position, a fully closed position, or an intermediate position to control the flow rate of fluid 200 through ICD 120. Further, in one or more embodiments, the control or adjustment of the inflow rate of fluid, the restriction of fluid inflow, or the pressure drop may all be parameters related to each other. Accordingly, as used herein, when referring to control or adjustment of one parameter, such as the inflow rate of fluid, may also be referring to control or adjustment of another parameter without departing from the scope of the present disclosure.

Actuator 300 may include a mechanical actuator (e.g., a screw assembly), an electrical actuator (e.g., piezoelectric actuator, electric motor), a hydraulic actuator (e.g., hydraulic cylinder and pump, hydraulic pump), a pneumatic actuator, and/or any other type of actuator known in the art. As illustrated, actuator 300 may comprise a shaft 304 and a crown 306. Additionally, shaft 304 may comprise a tip 308 that may at be at least partially angled. The angling of tip 308 may allow for the tip to form a fluid tight seal with seat 310. As illustrated, shaft 304 may at least partially be disposed within cavity 314 and at least partially disposed in chamber 312. A seal 325 may be disposed at the intersection of chamber 312 and cavity 314. Additionally, shaft 304 may pass through seal 325 and create a fluid tight seal between cavity 314, chamber 312, and shaft 304. It should be noted that cavity 314 may connect chamber 312 to fluid passageway 204. Generally, cavity 314 may be dimensioned to receive shaft 304 of actuator 300 with additional space to allow for fluid 200 to pass by shaft 304 and flow to fluid passageway 204. Further, crown 306 of actuator 300 may be disposed in chamber 312, which may create an area 316 defined as the space between crown 306 and chamber ceiling 320 and chamber wall 324. Additionally, chamber 312 may further comprise chamber floor 326.

Area 316 may be fluid tight area that expands, and contracts based at least in part on the location of crown 306. Movement of crown 306, and thus actuator 300, may increase or decrease area 316. The movement of crown 306 may be facilitated by hydraulic fluid 318 that may be fed into chamber 312 by hydraulic passageway 322. In examples, hydraulic passageway 322 may be tubing, voids within a housing, three dimensional printed paths within a material, gun drilled flow paths, and/or the like. Additionally, it should be noted that hydraulic passageway 322 may be any suitable shape and/or dimension to allow for actuator 300 to operate and function as described above and below. By increasing hydraulic fluid 318 into area 316, hydraulic fluid may increase pressure within area 316, which may apply a pressure to crown 306 and move shaft 304 and tip 308 of actuator 300 toward seat 310, which may decrease flow rate of fluid 200 into tubular string 112. In examples, this may also seat tip 308 to seat 310 and stop fluid flow through ICD 120. Likewise, by decreasing hydraulic fluid 318 within area 316 there may be less pressure asserted against crown 306. A spring 328 that may be at least partially in contact with chamber floor 326 and attached to crown 306 may exert a force on crown 306 and move actuator 300 away from seat 310. This may increase the flow rate of fluid 200 into tubular string 112.

Figure 4:
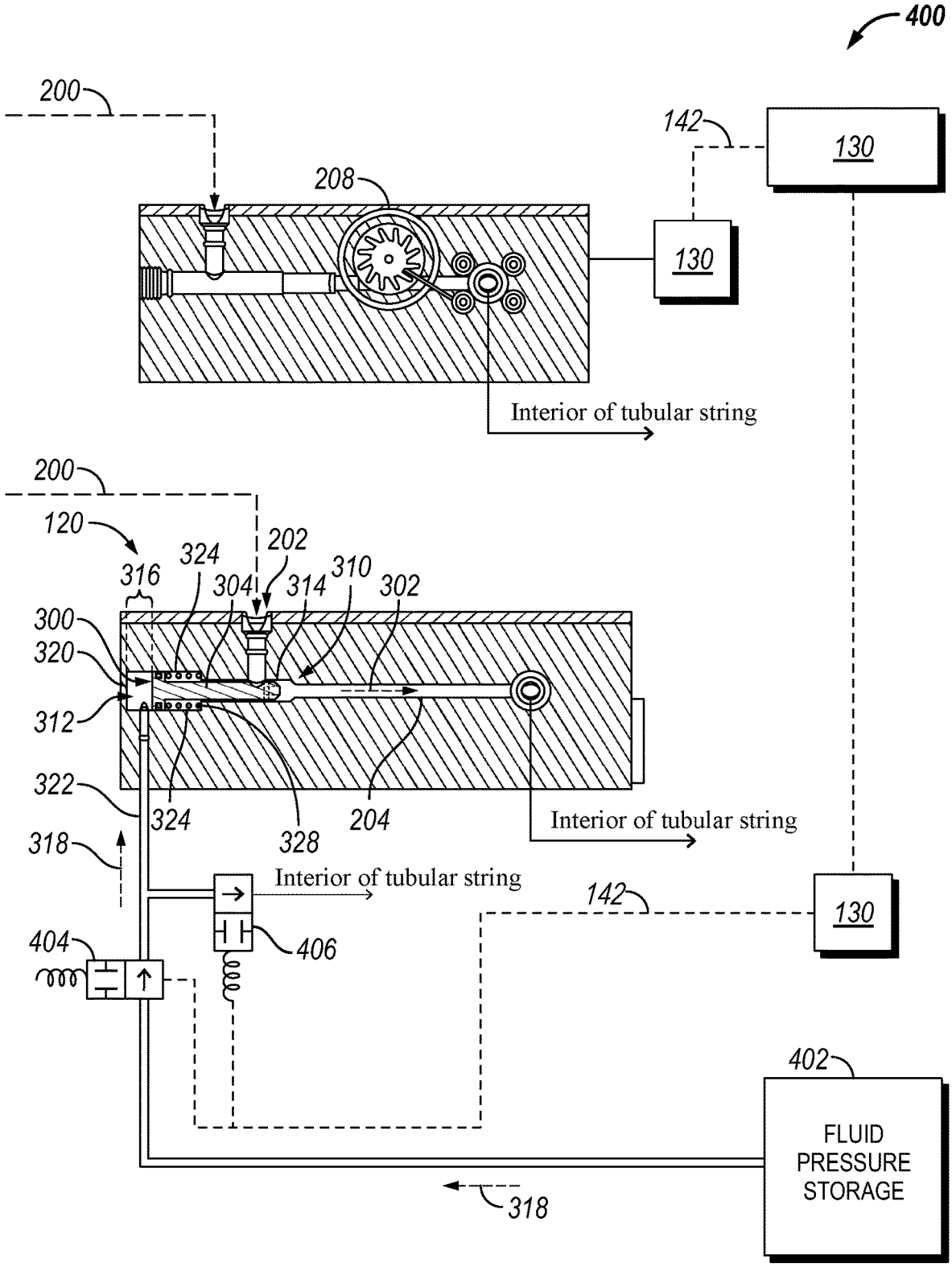
FIG. 4 is a schematic of one or more ICDs operating an actuator.

FIG. 4 illustrates a schematic of an electric inflow valve system 400 that may comprise one or more ICDs 120 that may be utilized in a formation production operation. As noted above, ICD 120, and more particularly actuator 300, may be used to control or adjust an inflow rate of fluid 200 received into ICD 120 through inlet flow path 202, control or adjust the restriction of fluid inflow received into ICD 120, and/or control or adjust a drop in pressure across ICD 120 (e.g., referring to FIGS. 3 and 4). The inflow rate of fluid 200 received into ICD 120 may be controlled by information handling system 130, disposed at surface, which may transmit one or more control signals downhole to operate one or more ICDs 120. A control signal may be sent to ICD 120 from information handling system 130 that may be disposed uphole or upstream of ICD 120, or even on or close to surface. Control signals may be sent to ICD 120 through the flow rate of mud or production fluid, or production fluid within tubular string 112, and more particularly by selectively fluctuating and varying the flow rate of mud or production fluid or production fluid received by ICD 120. A profile or pattern of flow rate fluctuations may be used to indicate a unique control signal, such as with communications involving flow rate telemetry. Accordingly, information handling system 130, controlling the flow rate of mud or production fluid through any number of devices known to one of ordinary skill in the art, may be able to encode one or more control signals through flow rate fluctuations of the mud or production fluid, and a receiver disposed on ICD 120 may measure the flow rate of the mud or production fluid. The receiver may be disposed on and/or near ICD 120 and may be an information handling system 130 or a at least a part of information handling system 130 and may be able to decode one or more controls signals through the flow rate fluctuations of the mud or production fluid. Information handling system 130 may transmit a control signal by generating flow rate fluctuations of the mud or production fluid uphole or downstream of ICD 120. Accordingly, to generate the flow rate fluctuations, information handling system 130 may control a choke, a bypass around a choke, a valve, a pump, or control the backpressure of the mud or production fluid at the surface, thereby selectively generating fluctuations in the flow rate of the mud or production fluid through tubular string 112 which may comprise one or more ICDs 120.

With continued reference to FIG. 4, information handling systems 130 disposed on and/or near ICD 120 may control any number of devices and/or their operations. It should be noted that there may be one or more information handling systems 130 that may work together to control ICD 120 and components within ICD 120. Additionally, in examples, at least one information handling system 130 may be disposed on ICD 120 and/or near ICD 120 on tubular string 112. These information handling systems may communicate with another information handling system 130 disposed at surface. Processing for measurements and transmission and receiving of signals may be performed at least partially by each information handling system. During operations, information handling system 130 may control the operations of power generator 208 disposed within an ICD 120. It should be noted that power generator 208 and actuator 300 may be disposed on the same or separated ICDs 120. Additionally, the same or another information handling system may control the operations of actuator 300. Generally, Formation production operations, using one or more ICDs 120, may be electric inflow control device(s) (EICD) that operate actuator 300. EICDs consume power downhole to move actuator 300. The power consumed may be generated by power generator 208. However, EICDs may have limited coupling force due to size constraints and magnetic arrays utilized to move actuator 300 in an EICD may be hindered by downhole pressure experienced within a formation. FIG. 4 illustrates a schematic that allows Formation production operations to be performed at higher downhole pressures and improve the available force to move actuator 300 while also improving the debris tolerance of the system. Debris tolerance may be increased due to the force available within ICD 120. With small actuation forces, debris or other friction adding elements may hinder movement. With big actuation forces, such as the forces described herein, debris is easily moved to the side.

The schematic in FIG. 4 illustrates at least two electric solenoids, controlled by information handling system 130 disposed on or near ICD 120 or at surface, may control the movement of hydraulic fluid 318 to move actuator 300. The hydraulic pressure may be stored or generated in several ways (reactions, springs etc.) and resupplied via tubing pressure. It may also be possible to convert one of the turbines into a hydraulic pump to charge a hydraulic reservoir to be used later. Further, one or more turbines may act as a hydraulic pump, or an electric pump may be utilized that is powered from one or more turbine generators.

As illustrated, fluid pressure storage 402 may be stored on and/or near ICD 120 on tubular string 112 (e.g., referring to FIG. 1). Hydraulic fluid 318 may exit fluid pressure storage 402 and connect to chamber 312 through hydraulic passageway 322, as described above. The flow of hydraulic fluid 318 to chamber 312 may be controlled by one or more solenoids 404 disposed in line of hydraulic passageway 322. Solenoids 404 may be controlled by information handling system 130 disposed on or near ICD 120 or at surface, which may be connected to solenoids 404 through communication channel 142. Communication channel may allow for communication between information handling system 130 and solenoids 404 through the flow rate of mud or production fluid, or production fluid within tubular string 112, as described above. Additionally, the production rate of mud or production fluid may be changed and correspond to RPM changes by one or more turbines.

During operations, information handling system 130 may actuate a solenoid 404 in line on hydraulic passageway 322 to allow for hydraulic pressure from fluid pressure storage 402 to force hydraulic fluid 318 into first area 316 of chamber 312, which may move actuator 300 toward seat 310, as described above. This may decrease the flow of fluid 200 along fluid flow path 302 in fluid passageway 204. Fluid 200 moving through inlet flow path 202 and along shaft 304 of actuator 300 may create a vacuum, causing actuator to be sucked toward and/or into seat 310. As described above, fluid 200 may flow to the inner diameter of tubular string 112. To move actuator 300 in the opposite direction, hydraulic passageway 322 may each have a relief solenoid 406 disposed inline or attached via branch tubing. To move actuator 300 in the opposite direction, solenoid 404 that is open on hydraulic passageway 322 may be closed, through control of information handling system 130, and relief solenoid 406 dispose on hydraulic passageway 322 may be open. This may allow for hydraulic fluid in area 316 to be forced out of chamber 312 and escape through open relief solenoid 406 to the inner diameter of tubular string 112. To force hydraulic fluid out of area 316, spring 328 may apply a force to crown 306 of actuator 300. This may move actuator 300 away from seat 310, forcing hydraulic fluid 318 into hydraulic passageway 322 and to relief solenoid 406, wherein hydraulic fluid 318 may flow into inner diameter of tubular string 112.

Figure 5:
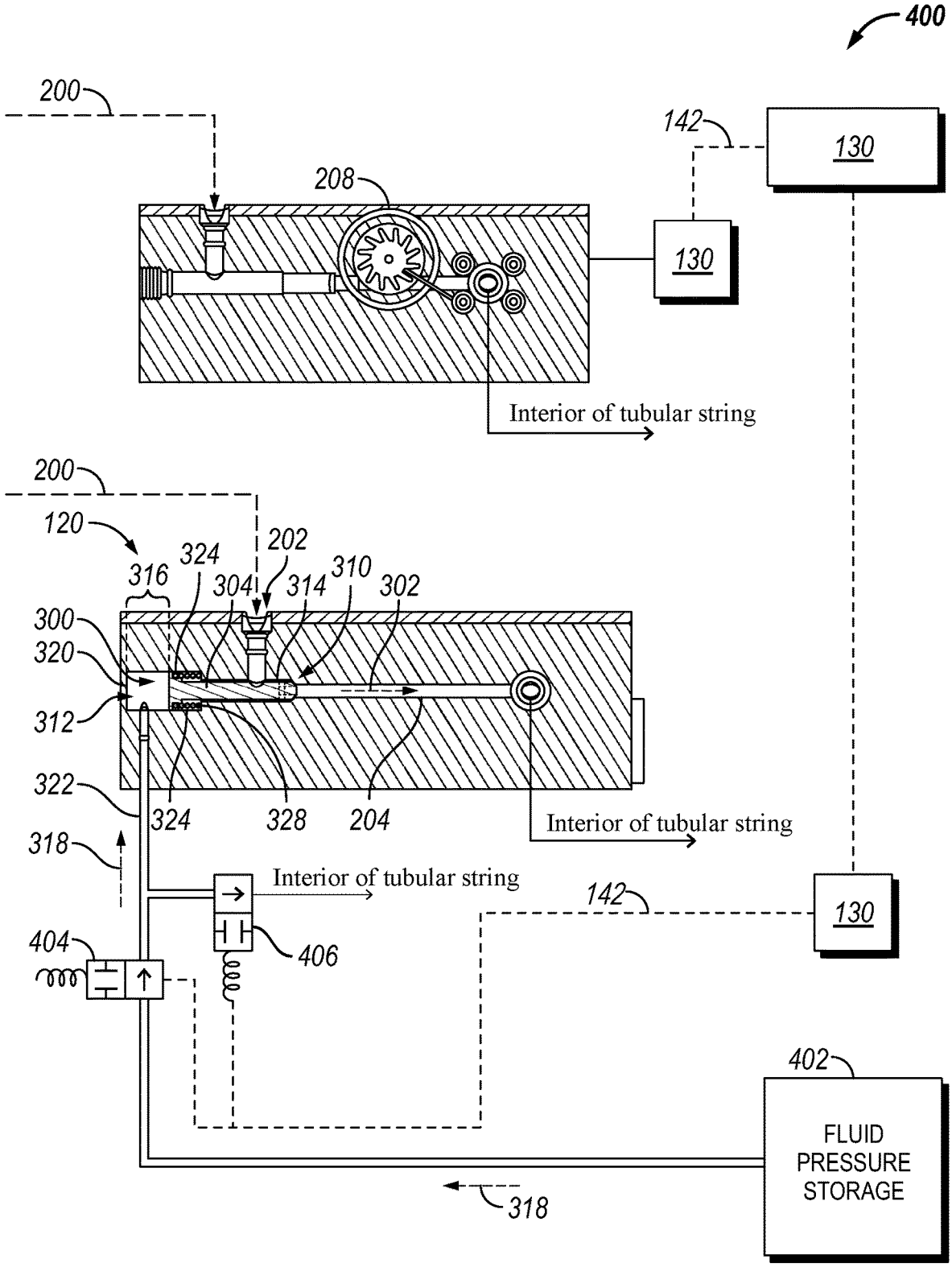
FIG. 5 is a schematic of one or more ICDs closing an actuator.

As shown in FIG. 5, actuator 300 has been seated to seat 310, preventing fluid 200 from moving into the inner diameter of tubular string 112. To move actuator 300 away from seat 310, relief solenoid 406 may be opened and solenoid 404 may be closed. Spring 328 may exert a force on crown 306 as described above and move actuator 300 away from seat 310, as described above. It should be noted that information handling system 130, which is connected to each solenoid 404 and relief solenoids 406 may control the speed, distance, and/or direction of actuator 300 using solenoid 404 and relief solenoids 406 using the principles of operation described above.

The methods and systems described above may allow for greater shifting forces by using hydraulic pressure rather than a magnetic coupling. The mechanical linkage is removed and replaced with hydraulic linkages which are easier to plumb and not prone to debris issues. The various systems, apparatus, methods, and other constructs may include any suitable combination of the features disclosed herein, including one or more of the following statements.

Statement 1: An inflow control device for a well may comprise a chamber, a cavity fluidly connected to the chamber, wherein the cavity comprises a seat, a fluid passageway fluidly connected to the cavity, an actuator at least partially disposed within the chamber and at least partially disposed in the cavity, a hydraulic passageway fluidly connected to the chamber, a fluid pressure storage fluidly connected to both the hydraulic passageway, and a solenoid disposed on the hydraulic passageway and configured to control a flow of a hydraulic fluid from the fluid pressure storage to the chamber.

Statement 2. The inflow control device of statement 1, further comprising a spring at least partially connected to a crown of the actuator and at least partially touching a chamber floor of the chamber.

Statement 3. The inflow control device of statements 1 or 2, further comprising a relief solenoid disposed on the hydraulic passageway between the chamber and the solenoid.

Statement 4. The inflow control device of statement 3, an information handling system communicatively connected to the solenoid and the relief solenoid.

Statement 5. The inflow control device of statement 4, wherein the information handling system is disposed at surface.

Statement 6. The inflow control device of statement 4 or 5, wherein the information handling system is disposed downhole on a tubing string or the inflow control device.

Statement 7. The inflow control device of any previous statements 4-6, wherein the information handling system is at least partially disposed downhole on a tubing string or inflow control device, and at least partially disposed at surface.

Statement 8. The inflow control device of any previous statements 1-3 or 8, wherein the actuator comprises a crown, a shaft, and an angled tip.

Statement 9. The inflow control device of statement 8, wherein the angled tip is configured to be set within the seat.

Statement 10. The inflow control device of statements 8 or 9, wherein the crown is disposed in the chamber.

Statement 11. The inflow control device of any previous statements 8-10, wherein the shaft is at least partially disposed in the chamber and at least partially disposed in the cavity.

Statement 12. The inflow control device of statement 11, wherein the shaft is disposed through a seal that separates the chamber and the cavity.

Statement 13. A method may comprise receiving a fluid from a formation with an inflow control device (ICD) disposed on a tubular string within a formation. The ICD may comprise a chamber, a cavity fluidly connected to the chamber, wherein the cavity comprises a seat, a fluid passageway fluidly connected to the cavity, an actuator at least partially disposed within the chamber and at least partially disposed in the cavity, a hydraulic passageway fluidly connected to the chamber, a fluid pressure storage fluidly connected to the hydraulic passageway, and a solenoid disposed on the hydraulic passageway and configured to control a flow of a hydraulic fluid from the fluid pressure storage to the chamber. The method may further comprise adjusting the actuator within the chamber and the cavity using the solenoid.

Statement 14. The method of statement 13, further comprising a relief solenoid disposed on the hydraulic passageway between the chamber and the solenoid.

Statement 15. The method of statement 14, further comprising a spring at least partially connected to a crown of the actuator and at least partially touching a chamber floor of the chamber.

Statement 16. The method of statements 14 or 15, an information handling system communicatively connected to the solenoid and the relief solenoid.

Statement 17. The method of statement 16, wherein the information handling system is disposed at surface or downhole on a tubing string.

Statement 18. The method of any previous statements 16 or 17, wherein the information handling system is at least partially disposed downhole on a tubing string and at least partially disposed at surface.

Statement 19. The method of statements 13 or 14, further comprising seating the actuator to the seat by adjusting the solenoid.

Statement 20. The method of any previous statements 13, 14, or 19, further comprising un-seating the actuator to the seat by adjusting the solenoid.

The preceding description provides various examples of the systems and methods of use disclosed herein which may contain different method steps and alternative combinations of components. It should be understood that, although individual examples may be discussed herein, the present disclosure covers all combinations of the disclosed examples, including, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. An inflow control device for a well, comprising:

a tubular string having an inner diameter;

a chamber;

a cavity defining a seat;

a fluid passageway fluidly connected to the cavity;

an actuator at least partially disposed within the chamber and at least partially disposed in the cavity, wherein fluid from the well is allowed to flow through the seat and into the inner diameter of the tubular string when the actuator is in an open position;

a hydraulic passageway fluidly connected to the chamber;

a fluid pressure storage fluidly connected to the hydraulic passageway; and a solenoid disposed on the hydraulic passageway and configured to control a flow of a hydraulic fluid from the fluid pressure storage to the chamber;

a relief solenoid disposed on the hydraulic passageway between the chamber and the solenoid, wherein the relief solenoid directs the hydraulic fluid from a location external to the inner diameter of the tubular string into the inner diameter of the tubular string:

at least one power generator, disposed in the inflow control device, the at least one power generator being responsive to the flow of fluid to generate power; and at least one power storage device to store power generated by the at least one power generator.

2. The inflow control device of claim 1, further comprising a spring at least partially connected to a crown of the actuator and at least partially touching a chamber floor of the chamber.

3. The inflow control device of claim 1, an information handling system communicatively connected to the solenoid and the relief solenoid.

4. The inflow control device of claim 3, wherein the information handling system is disposed at surface.

5. The inflow control device of claim 3, wherein the information handling system is disposed downhole on a tubing string or the inflow control device.

6. The inflow control device of claim 3, wherein the information handling system is at least partially disposed downhole on a tubing string or inflow control device, and at least partially disposed at surface.

7. The inflow control device of claim 1, wherein an angled tip of the actuator is configured to be set within the seat.

8. The inflow control device of claim 1, wherein a crown of the actuator is disposed in the chamber.

9. The inflow control device of claim 1, wherein a shaft of the actuator is at least partially disposed in the chamber and at least partially disposed in the cavity.

10. A method, comprising:

receiving a fluid from a formation with an inflow control device (ICD) disposed on a tubular string within a formation, wherein the ICD comprises:

a chamber; a cavity defining a seat;

a fluid passageway fluidly connected to the cavity;

an actuator at least partially disposed within the chamber and at least partially disposed in the cavity;

a hydraulic passageway fluidly connected to the chamber;

a fluid pressure storage fluidly connected to the hydraulic passageway; and a solenoid disposed on the hydraulic passageway and configured to control a flow of a hydraulic fluid from the fluid pressure storage to the chamber;

a relief solenoid disposed on the hydraulic passageway between the chamber and the solenoid, wherein the relief solenoid is configured to direct the hydraulic fluid from a location external to an inner diameter of the tubular string into the inner diameter of the tubular string:

at least one power generator disposed in the inflow control device; and at least one power storage device;

adjusting the actuator within the chamber and the cavity using the solenoid wherein the at least one power generator is responsive to the flow of fluid through the fluid passageway to generate power; and wherein the at least one power storage device is configured to store power generated by the at least one power generator.

11. The method of claim 10, further comprising a spring at least partially connected to a crown of the actuator and at least partially touching a chamber floor of the chamber.

12. The method of claim 10, an information handling system communicatively connected to the solenoid and the relief solenoid.

13. The method of claim 12, wherein the information handling system is disposed at surface or downhole on a tubing string.

14. The method of claim 12, wherein the information handling system is at least partially disposed downhole on a tubing string and at least partially disposed at surface.

15. The method of claim 10, further comprising seating the actuator to the seat by adjusting the solenoid.

16. The method of claim 10, further comprising unseating the actuator to the seat by adjusting the solenoid.

* * * * *